US005544821A

United States Patent [19]

Gupta et al.

[11] Patent Number: 5,544,821

[45] Date of Patent: Aug. 13, 1996

[54] ENERGY EFFICIENT CENTRIFUGAL GRINDER

[76] Inventors: Rajendra P. Gupta, 9 Veery Lane, Gloucester, Ontario, Canada, K1J 8X4; Grant W. Wood, 836 Vinette Crescent, Orleans, Ontario, Canada, K1E 1W9

[21] Appl. No.: 493,414

[22] Filed: Jun. 22, 1995

[51] Int. Cl.[6] ..... B02C 7/175

[52] U.S. Cl. ..... 241/46.017; 241/74; 241/162

[58] Field of Search ..... 241/74, 162, 46.017, 241/46.17, 46.02

[56] References Cited

U.S. PATENT DOCUMENTS

| | | | |
|---|---|---|---|
| 997,592 | 7/1911 | Abbe | 241/162 |
| 1,159,138 | 11/1915 | Vecchini | 241/162 |
| 2,519,198 | 8/1950 | Richeson | 241/162 |
| 2,653,770 | 9/1953 | Vicci | 241/162 |
| 2,738,930 | 3/1956 | Schneider | 241/162 |
| 2,738,931 | 5/1956 | Schneider | 241/162 |
| 3,993,791 | 11/1976 | Breed | 426/436 |
| 4,641,792 | 2/1987 | Villavicencio et al. | 241/74 |
| 4,915,972 | 4/1990 | Gupta . | |

FOREIGN PATENT DOCUMENTS

| | | | |
|---|---|---|---|
| 1005895 | 3/1983 | U.S.S.R. | 241/162 |

*Primary Examiner*—John M. Husar

[57] ABSTRACT

A grinder of solids or solids in liquids has a multiple milling stages. A rotating disc plate carries cutting elements on one side and hammer elements on another, both located at the circumference of the disc plate. The disc plate is rotated in a screened chamber to which the solids or the liquids containing solids to be ground are introduced. Ground product or slurry containing disintegrated solids is passed through the screen before discharged. The use of disc plate and milling elements reduces required torque, leading to improved energy efficiency and results in better performance of the grinder.

10 Claims, 4 Drawing Sheets

ENERGY EFFICIENT CENTRIFUGAL GRINDER

FIELD OF THE INVENTION

The present invention relates generally to a grinder for grinding solids or solids in liquid. In particular it is directed to a grinder which includes cutting elements and hammering elements provided on either side of a rotatable disc for energy efficient operation.

BACKGROUND OF THE INVENTION

It is often required to disintegrate solids in liquids without incorporating air in certain processes for air could induce undesirable oxidation of the resulting solid-liquid slurry and/or induce foaming. An example is the disintegration of soybeans in water in order to make soymilk. In U.S. Pat. No. 4,915,972 Apr. 10, 1990 Gupta, such disintegration process is described in connection with production of soymilk.

The disintegration of solids in liquids is often achieved by high speed rotating hammermills. However, prior art hammermills create extreme vortex in liquids which induces suction of air in the comminuting region. A hammermill also requires very high starting torque if the solids are already in the mill when it is started. The drive motor has to be sized to provide the required high starting torque, which is expensive and inefficient for running operation. In addition, it yields solid particles of large variation in size which often requires two or more mills in tandem to get reasonable grind of the solids. Alternately, the slurry has to be recirculated many times through the same hammermill. Either approach results in increased capital cost and reduced energy efficiency. U.S. Pat. Nos. 2,738,930 and 2,738,931 May 20,1956 Schneider teach dispersion apparatus in which a preliminary comminuting system is followed by a plurality of dispersion systems. U.S. Pat. No. 2,519,198 Aug. 15,1950 Richeson describes a coffee grinding or comminuting machines having a plurality of rotating cutting elements. U.S. Pat. No. 3,993,791 Nov. 23, 1976 Breed et al is directed to a continuous lautering apparatus in which a series of continuously decanting centrifuges and an equal number of reslurry stations are provided.

The present invention eliminates these deficiencies of a hammermill and provides a highly cost-effective method of grinding for general purpose such as dry grinding of grains, spices, minerals, and other food and non-food products. It is also is suitable for grinding solid in liquids such as ordinary, choked, flooded, and airless grinding. This is achieved by locating the hammering elements only in the vicinity of the impacting surface rather than using the whole rotating element as hammer. The starting and running torque requirement of the drive motor is greatly reduced and energy use efficiency is improved. The motor torque requirement and energy efficiency is further improved by dividing the milling regions into two or more sections. This division also results in good control on the particle size distribution of the grind and eliminates the need for multiple mills or multiple passes to achieve a good grind.

OBJECTS OF THE INVENTION

It is therefore an object of the invention to provide a centrifugal grinder which is energy efficient and produces uniform particle size distribution.

It is another object of the invention to provide a grinder which produces higher yield and quality of the end product.

It is yet a further object of the invention to provide an airless grinder which is energy efficient.

It is still an object of the invention to provide an airless grinder which has a rotating disc with hammer and cutter elements at perimeter.

SUMMARY OF THE INVENTION

Briefly stated, the invention is directed to an energy efficient centrifugal grinder for grinding solids in liquids into resulting solid-liquid slurry which minimizes the formation of vortex and concomitant suction of air into the resulting solid-liquid slurry. The grinder comprises a housing having a screen wall defining the housing into a first and second chambers. A first rotatable disc in the first chamber substantially conforms to the size of the first chamber and is rotatable about a central perpendicular axis. The grinder further has cutters attached on a first side of the first rotatable disc near but inside its perimeter and hammers attached on a second side of the first rotatable disc near but inside its perimeter. An inlet connects to the first chamber for introducing the solids in liquids to the first side of disc and an outlet connects to the second chamber for discharging the solid-liquid slurry therefrom. A motor mechanically connecting the first rotatable disc to drive the first rotatable disc.

DETAILED DESCRIPTION OF THE PREFERRED EMBODIMENTS OF THE INVENTION

Figure 1:
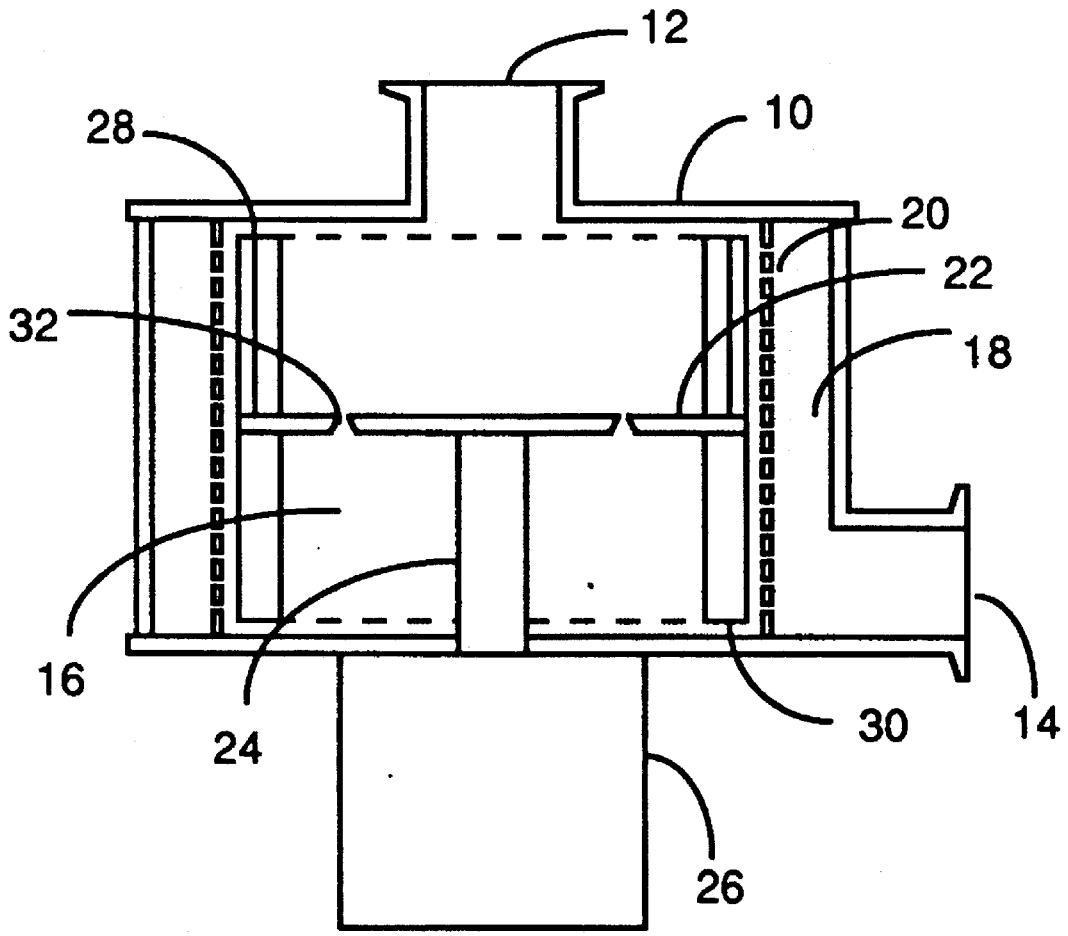
FIG. 1 is a sectional view of the grinder according to one embodiment of the invention.

FIG. 1 shows schematically a grinder according to one embodiment of the invention. The grinder includes a housing 10 which is provided with an inlet 12 and an outlet 14. The housing is cylindrical in shape in cross section and is divided into two chambers 16 and 18 by a screened wall 20. A disc plate 22 is in the first chamber 16 and is attached on an axle 24 which is in turn adapted to be rotated at high speed by a motor 26. The disc plate 22 has two or more cutter elements 28 attached to its upper side and two or more hammer elements 30 attached to its lower side. The cutter and hammer elements are attached to the disc plate 22 near its circumference. In a further embodiment, the disc plate is provided with few tapered holes 32 which are too small for the unground solids to go through. These holes improve circulation of ground product below the plate. They are particularly beneficial when solids are to be ground in the presence of a liquid.

Solids or solids in liquids are introduced into the grinder through the inlet 12. When the disc plate 22 is rotated, the solids are centrifugally thrown out towards the screen wall in the path of the spinning cutters 28 which chop down the solids to small pieces. The small solid pieces then enter the lower region where spinning hammers 30 grind them to a particle size which is a function of the holes size in the screen. The ground solids suspended in the liquid are removed through the outlet 14.

In this embodiment, the torque requirement and vortex formation are improved over the prior art grinders and consequently improves energy efficiency. These improvements are results of the following features. Instead of one or more vertical bars as hammers, the invention uses the cutter and hammer elements attached on a horizontal circular plate. The milling chamber is divided in two regions.

The improvement can be illustrated as follows. If the thickness of a cutter element is t1 and the height is h1, the thickness of a hammer element is t2 and the height is h2, and the diameter of the disc plate is D, then the total volume V1 swept by the cutter and hammer elements is:

$$V1=\pi D(t1*h1+t2*h2)\ [\pi=3.14159]$$

Prior art hammer mills have solid metal bars as hammers. Assuming h1+h2 as their height and D as their length, the volume V2 swept by them is:

$$V2=\pi D*D(h1+h2)/4$$

Assuming for simplicity the thickness of the cutter and hammer elements to be the same, t1=t2=t (say), and dividing V1 by V2:

$$V1/V2=4.t/D.$$

Typically, t=⅛" when D=4", giving V1/V2=⅛. This ratio then roughly defines the ratio of the strength of the vortex for the two mills without the disc plate. However, the presence of the disc plate greatly reduces the swept volume available for vortex formation for the present invention—the inlet can only see the swept volume V1' above the disc plate. Since h1 is typically ⅓ of h2, $$V1'=\pi D*t*h1;\ \text{or}\ V1'/V2=t/D,$$

Which has a value 1/32 for the typical dimensions considered here. The grinder of the invention therefore has a very small vortex and as a result extremely small suction for air to get into it. If this small vortex is still problematic, it could be further reduced by inserting a vortex-cross in the inlet of the grinder.

Assuming s to be the specific gravity of the solid-liquid swept by the grinder and r to be the distance of an element thickness dr from the axis, the ratio of the torques (T1 for the present invention and T2 for the prior art hammermill) can be easily determined as follows:

$$T1 = K*\text{mass}*\text{distance}^2 = K*\{2\pi R(h1+h2)t*s\}R^2\ [R=D/2]$$

$$T2 = K*\text{integral}(0\text{ to }R)[\{2\pi r(h1+h2)dr*s\}r^2]$$

$$= K*\{2\pi(h1+h2)s*R^4/4\}$$

T1/T2=8t/D=¼(for t=⅛" and D=4" as above). Here K is a proportionality constant.

This is a marked decrease in the torque requirement. The preceding analysis can qualitatively be envisioned from FIG. 1. When rotated axially, the area swept by hammer and cutter elements is obviously a fraction of the area swept by the rectangle formed by connecting the elements as shown by the dotted lines 32. It would take a lot more torque to rotate the latter arrangement than the former when the space inside the screen is filled with solids. It is not difficult to see that even the running torque is lower, leading to improved energy efficiency.

Figure 2:
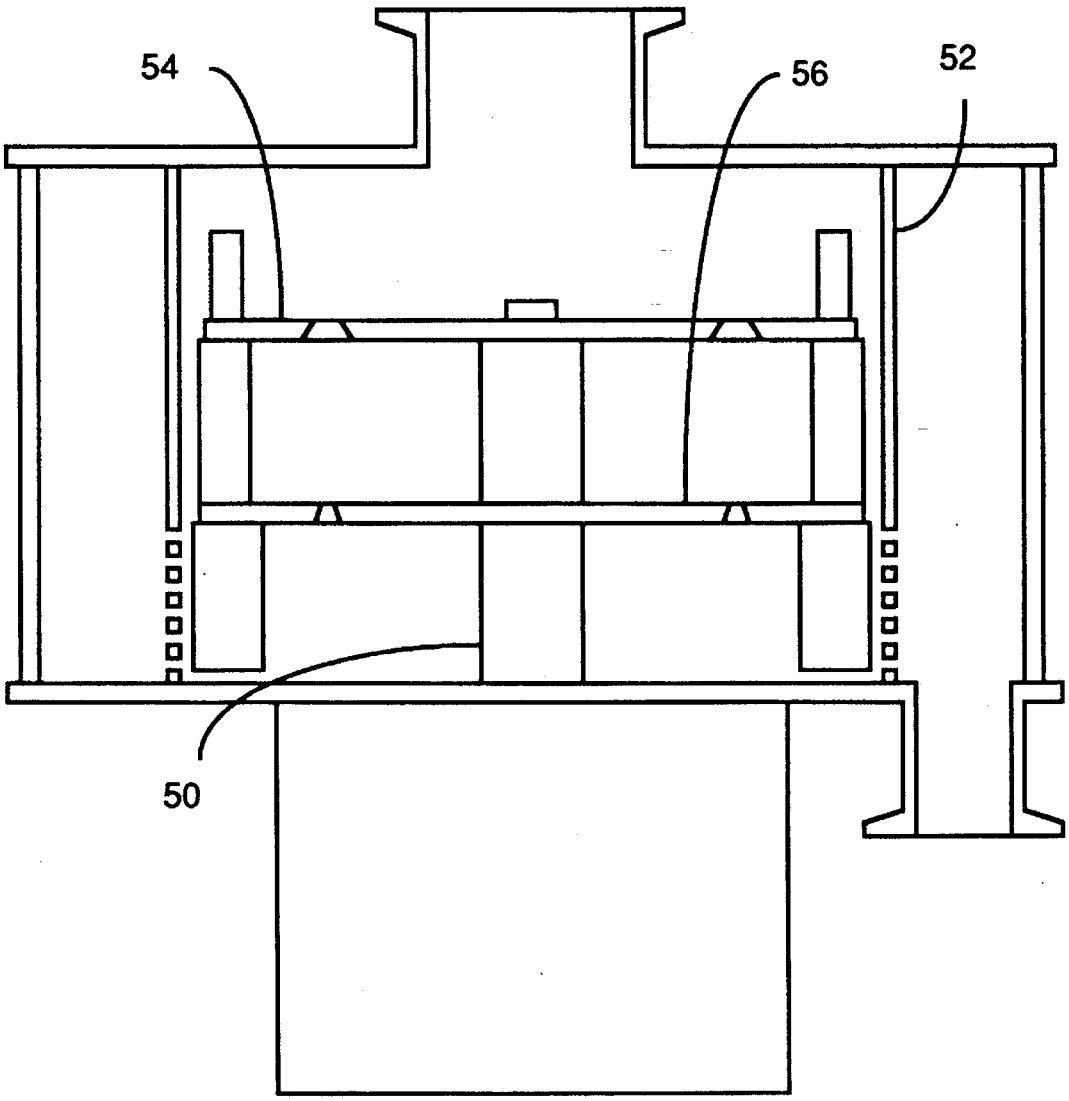
FIGS. 2–4 are sectional views of multi-stage grinders according to several embodiments of the invention.
Figure 3:
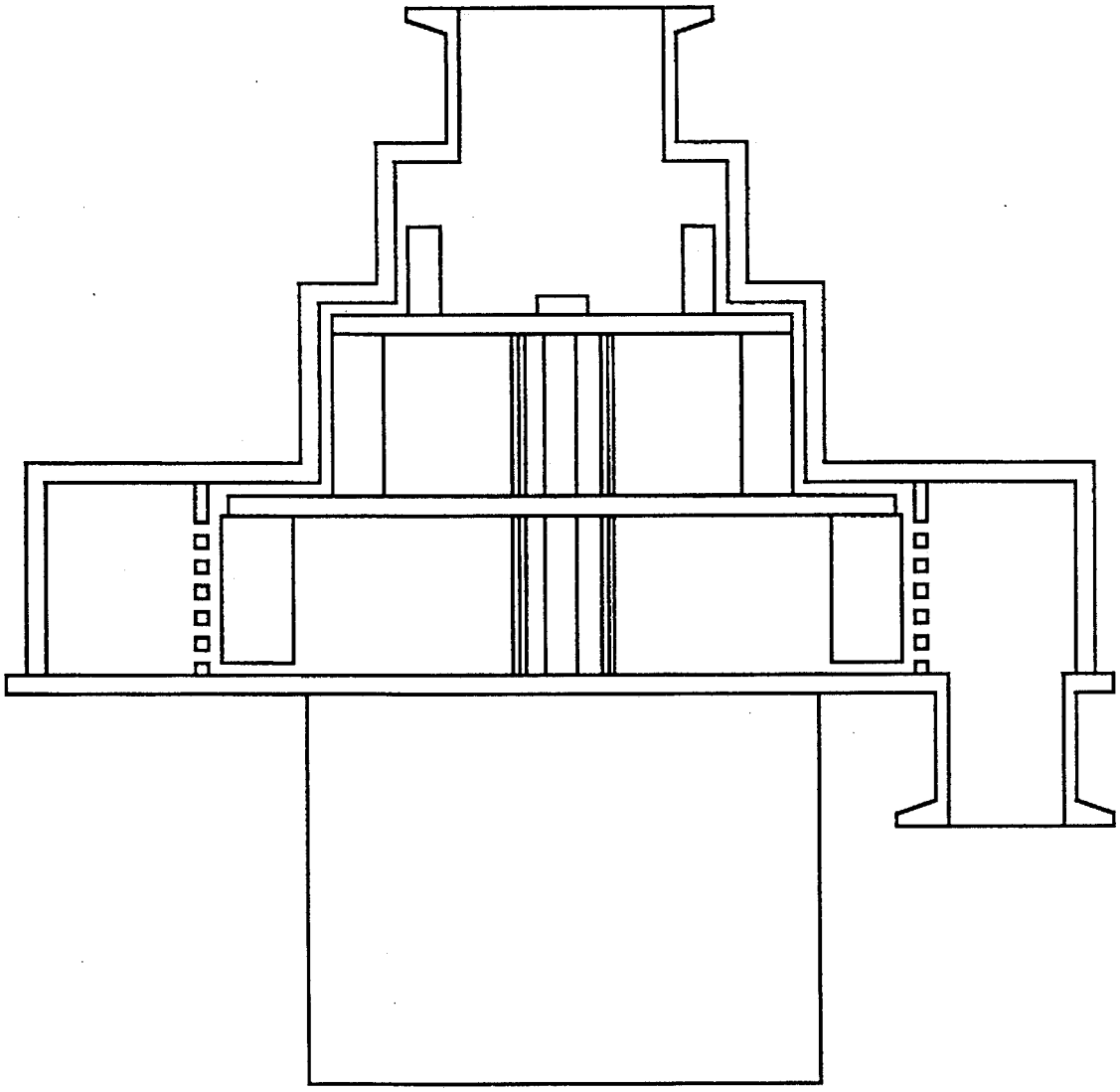
Figure 4:
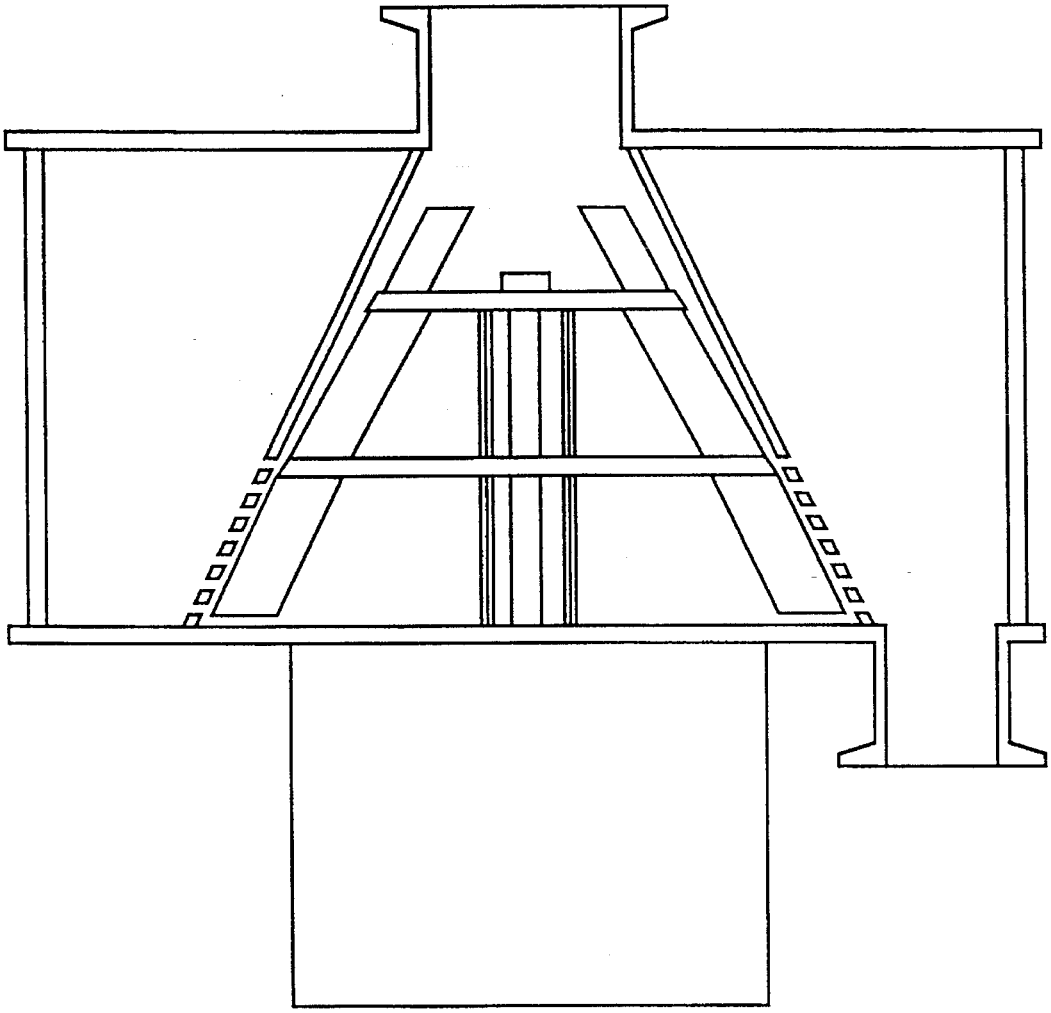

Referring to FIGS. 2–4, three additional embodiments of the invention are also schematically shown.

In FIG. 2, the grinder has a single impeller mounted on a drive shaft 50 of a motor and is surrounded by a fixed cylindrical screen 52. The impeller has multiple grinding stages separated by discs 54 and 56 concentric with the shaft. The grinding elements, like cutters and hammers, are symmetrically mounted on the discs. As the solid such as beans gets crushed or chopped to a certain size by one stage of the grinding, they progress to the next finer stage of grinding or chopping through the opening between the discs and the screen. The section of the screen surrounding the final stage of the grinder has perforations that allow the finely ground solids to exit the grinder. Although the grinder screen may be perforated everywhere, it is undesirable to do so for two reasons: a) the slurry flow between stages is enhanced if the water cannot flow out of the screen in the earlier stages of grinding, and b) it costs money to make perforations in any material, i.e., fewer the perforations, cheaper the screen. For some applications, it may be desirable to have openings in the top section of the screen as well to permit local circulation of the liquid and slurry in the grinder. In other embodiments, the discs are provided with holes which are too small for solids larger than a certain size to go through.

In FIGS. 3 and 4, multistage grinders are shown in which progressively larger discs are used for better grinding performance.

The grinder of the present invention produces a more uniform particle size distribution in the grind than the prior art and reduces energy and power requirement in grinding a material to desired fineness. The grinding elements last longer and are economical to manufacture. The grinder of the invention also produces higher yield and quality of the end product. It is adaptable to dry grinding of grains, spices, minerals, and other food and non-food products; and is suitable for ordinary, choked, flooded, and airless grinding.

I claim:

1. An energy efficient centrifugal grinder for grinding solids in liquids into resulting solid-liquid slurry which minimizes the formation of vortex and concomitant suction of air into said resulting solid-liquid slurry; comprising:

a housing having a screen wall defining the housing into a first and second chambers, a first rotatable disc in the first chamber substantially conforming to the size of the first chamber and being rotatable about a central perpendicular axis, cutters attached on a first side of the first rotatable disc near but inside its perimeter, hammers attached on a second side of the first rotatable disc near but inside its perimeter, an inlet connecting to the first chamber for introducing the solids in liquids to the first side of the disc, an outlet connecting to the second chamber for discharging the solid-liquid slurry therefrom, and motor mechanically connecting the first rotatable disc to drive the same.

2. The energy efficient centrifugal grinder for grinding solids in liquids according to claim 1, further comprising a second rotatable disc parallel with the first rotatable disc and rotatable about said axis, the second rotatable disc having the hammers on its first side near but inside its perimeter, fine grinding hammers attached on the second side of the second rotatable disc near but inside its perimeter.

3. The energy efficient centrifugal grinder according to claim 2 wherein the first and second rotatable discs have holes therein whose sizes are smaller than that of unground solids.

4. The energy efficient centrifugal grinder according to claim 3 wherein the screen wall is cylindrical in shape defining the first chamber therein and has screen holes.

5. The energy efficient centrifugal grinder according to claim 4 wherein the screen holes are only near the fine grinding hammers.

6. The energy efficient centrifugal grinder according to claim 5 wherein the second rotatable disc is larger in diameter than the first rotatable disc.

7. The energy efficient centrifugal grinder according to claim 6 wherein the first chamber is conical in shape, and the cutters, hammers and fine grinding hammers are attached to the first and second rotatable discs at angles to roughly conform to the conical shape of the first chamber.

8. The energy efficient centrifugal grinder according to claim 4 wherein the second rotatable disc is larger in diameter than the first rotatable disc.

9. The energy efficient centrifugal grinder according to claim 8 wherein the first chamber is conical in shape, and the cutters, hammers and fine grinding hammers are attached to the first and second rotatable discs at angles to roughly conform to the conical shape of the first chamber.

10. The energy efficient centrifugal grinder according to claim 1 wherein the first rotatable disc has holes therein whose size is smaller than that of unground solids.

* * * * *